US011732873B2

(12) United States Patent
Cerv et al.

(10) Patent No.: US 11,732,873 B2
(45) Date of Patent: Aug. 22, 2023

(54) END CAP FOR A LIGHT STRIP LAMP

(71) Applicant: ZUMTOBEL LIGHTING GMBH, Dornbirn (AT)

(72) Inventors: Simon Cerv, Dornbirn (AT); Gerhard Galler, Bregenz (AT)

(73) Assignee: Zumtobel Lighting GmbH, Dornbirn (AT)

( * ) Notice: Subject to any disclaimer, the term of this patent is extended or adjusted under 35 U.S.C. 154(b) by 0 days.

(21) Appl. No.: 17/599,043

(22) PCT Filed: Apr. 15, 2020

(86) PCT No.: PCT/EP2020/060542

§ 371 (c)(1),
(2) Date: Sep. 28, 2021

(87) PCT Pub. No.: WO2020/224921

PCT Pub. Date: Nov. 12, 2020

(65) Prior Publication Data

US 2022/0178518 A1 Jun. 9, 2022

(30) Foreign Application Priority Data

May 6, 2019 (DE) ..... 20 2019 102 513.1

(51) Int. Cl.
*F21V 15/015* (2006.01)
*F21S 4/28* (2016.01)
(Continued)

(52) U.S. Cl.
CPC ..... *F21V 15/015* (2013.01); *F21S 2/005* (2013.01); *F21S 4/28* (2016.01); *F21V 21/005* (2013.01);
(Continued)

(58) Field of Classification Search
CPC ..... F21S 2/00–005; F21S 4/00–28; F21V 15/00–04; F21V 21/005; F21Y 2103/10; F21Y 2115/10
See application file for complete search history.

(56) References Cited

U.S. PATENT DOCUMENTS 8,746,933 B2 * 6/2014 Cho ..... F21S 4/20 362/249.02
9,995,466 B2 * 6/2018 SanFacon ..... F21V 17/104
(Continued)

FOREIGN PATENT DOCUMENTS

| | | |
|---|---|---|
| DE | 20 2011 051 094 | 11/2012 |
| DE | 10 2012 202 148 | 8/2013 |
| WO | 2012034107 | 3/2012 |

OTHER PUBLICATIONS

International Search Report and Written Opinion dated Jul. 9, 2020 in parent PCT Application PCT/EP2020/060542.

*Primary Examiner* — Jason M Han
(74) *Attorney, Agent, or Firm* — Andrus Intellectual Property Law, LLP

(57) ABSTRACT

The present invention relates to an end cap (100) for a light strip lamp, having a flat main body (101) with two opposite flat sides (110, 140), the flat sides (110, 140) having a flat cover side (140) for covering a front face of a light strip lamp and a coupling side (110) for coupling to an identical end cap (100) of a laterally adjacent light strip lamp, the coupling side (110) having coupling structures (200), which are designed such that they can be releasably connected without the use of tools to the coupling structures (200) of a coupling side (110) of an identical end cap (100).

18 Claims, 11 Drawing Sheets

(51) Int. Cl.

| | |
|---|---|
| ***F21S 2/00*** | (2016.01) |
| ***F21V 21/005*** | (2006.01) |
| ***F21Y 103/10*** | (2016.01) |
| ***F21Y 115/10*** | (2016.01) |

(52) U.S. Cl.
CPC ..... *F21Y 2103/10* (2016.08); *F21Y 2115/10* (2016.08)

(56) References Cited

U.S. PATENT DOCUMENTS

| | | | | |
|---|---|---|---|---|
| 10,451,254 | B2 * | 10/2019 | Didone' ..... | F21V 21/005 |
| 2010/0073929 | A1 * | 3/2010 | Gingrich, III ..... | F21V 17/164 362/373 |
| 2018/0180265 | A1 | 6/2018 | SanFacon et al. | |

* cited by examiner

END CAP FOR A LIGHT STRIP LAMP

CROSS REFERENCE TO RELATED APPLICATIONS

The present application is the U.S. national stage application of international application PCT/EP2020/060542 filed Apr. 15, 2020, which international application was published on Nov. 12, 2020 as International Publication WO 2020/224921 A1. The international application claims priority to German Patent Application 20 2019 102 513.1 filed May 6, 2019.

FIELD OF THE INVENTION

The present invention relates to an end cap for a light strip lamp and a light strip lamp comprising an elongated lamp support with two end faces, at least one of which is covered by an end cap according to the invention. The invention further relates to a light strip system comprising the light strip lamp according to the invention.

BACKGROUND OF THE INVENTION

Light strip systems that consist of a plurality of elongated individual lamps arranged in a row are known from the state of the art.

An individual lamp used for this purpose typically comprises an elongated mounting rail in which the lighting means and other electronic components are accommodated. The mounting rail, which is frequently U-shaped, is usually fastened to cable suspensions, ceiling or wall surfaces via its upper side such that it is open on its underside. The individual lamps often have end caps on their two front faces to protect the individual lamp and its components from environmental influences.

Known light strip systems from the state of the art use separate connecting elements, such as a clip or a bridge element, to connect the mounting rails of two adjacent individual lamps to one another. However, such a solution has the disadvantage that the assembly and installation of the light strip system is laborious. The mounting rails furthermore have to be positioned relatively precisely with respect to one another in order to avoid the occurrence of gaps between the lighting means of the respective individual lamps accommodated in the mounting rails. Even minor deviations can negatively affect the overall appearance of the light strip system. The high precision requirements with regard to positioning consequently further increase the effort required for assembly and installation. Alternative solutions, in which connecting elements are already integrated in the mounting rail to reduce the effort of assembly, often require a complex rail structure and the provision of different types of mounting rails, such as beginning, connecting and ending rails. This increases the costs for planning, assembling, and installing a light strip system.

Mounting individual lamps independently of one another on the surface provided for fastening is known from the state of the art as well. However, this too can result in the occurrence of undesirable gaps between the lighting means if the individual lamps are positioned or aligned imprecisely relative to one another. This can have a negative effect on the overall appearance of the light strip system. However, even when the individual lamps are precisely aligned and positioned, thermal expansion of the light strip system can occur if permissible operating temperatures are exceeded, as a result of which gaps develop between the individual light strip lamps. Again, this can have a negative effect on the overall appearance of the light strip system.

SUMMARY OF THE INVENTION

It is therefore an object of the present invention to provide an end cap, a light strip lamp and a light strip system with which the aforementioned problems known from the state of the art can be overcome. It is in particular an object of the present invention to find a solution according to which individual lamps can be connected to one another in a simple and inexpensive manner and aligned and positioned with respect to one another with a relatively high degree of precision.

This object is achieved by the features of the independent claims. The dependent claims further develop the central concept of the present invention in a particularly advantageous manner.

One aspect of the present invention relates to an end cap for a light strip lamp. The end cap comprises a flat main body with two opposite flat sides.

In the context of the invention, "flat" is preferably understood to mean extending in substantially one plane. In other words, a "flat side" extends substantially in an (extension) plane subtended by said side. The invention is not limited to this, however, and can in principle also include three-dimensional surfaces.

The flat sides comprise a flat cover side for covering a front face of a light strip lamp and a coupling side for coupling to an identical end cap of a laterally adjacent light strip lamp. The coupling side comprises coupling structures which are configured such that they can be releasably connected to the coupling structures of a coupling side of an identical end cap without the use of tools.

According to the invention, a "releasable connection" is in particular understood to mean a (mechanical) connection that enables the (mechanically) connected components to be uncoupled in a non-destructive manner or released from one another in a non-destructive manner.

In other words: the end cap according to the invention thus provides a component, by means of which a cover of a front face of a light strip lamp and also a (preferably mechanical) coupling of two light strip lamps (preferably respectively via their front face) can be provided. For this purpose, coupling structures are provided on one of the two flat sides of the end cap, the coupling side, by means of which a releasable connection between two end caps can be provided and produced without the use of tools.

Thus, a component is provided, with which a cover element of a lamp and also a connecting element for connection to another lamp can be provided. The end cap can therefore provide a variety of functions.

For example, the end cap provides means for the (mechanical) coupling of lamps so that the lights themselves do not need any structures for this purpose. The end cap according to the invention can be used for different lamps, because the coupling structures of the end cap can be provided independently of the specifications of the lamp. The connection of the end cap and the lamp enables them to be aligned and positioned in a defined manner, so that the assembly of a light strip system can be simplified. Unlike the already known connecting elements, however, the functional scope of the end cap is not limited to the mere provision of connecting means. Rather, the end cap can also be used to cover the lamp, so that, perhaps, there is no need for separate cover elements in the lamp. The end cap can thus also assume a protective function for the components accommodated in the lamp. The end cap furthermore enables a tool-free and releasable connection with another structurally identical end cap. This simplifies assembly, installation, and maintenance, and saves costs.

The end cap according to the invention thus has a wide range of functions, a high potential for cost savings, in particular during assembly, and a high degree of flexibility.

According to a further development, the coupling structures can be configured to align two end caps coupled via the coupling structures with one another.

It thus becomes possible to use the end cap to define and provide positioning and alignment of the components to be connected to one another. The functional scope of the end cap as an additional positioning aid is thus expanded.

According to another further development, the coupling structures can be configured to release two end caps coupled via the coupling structures via a relative movement of the end caps to one another at least in a direction orthogonal and/or parallel to an extension plane of the flat main body.

The connection of two end caps can thus be released by simple means. This can facilitate and simplify assembly. The option of releasing the connection by movement in two different axial directions further increases the flexibility during assembly and maintenance. For instance, a lamp comprising such end caps could optionally be released from a lamp grouping by a movement along a longitudinal axis of the lamp or by a movement perpendicular to said axis. Thus, the functional scope of the end cap grows further.

According to a further development, the coupling structures can each comprise a first connecting structure and a second connecting structure, which are configured to correspond structurally to the tool-free and releasable connection to the respective other connecting structure of an identical end cap. Alternatively or additionally, the main body, in particular the coupling side, can comprise two regions which are configured to correspond structurally to one another. Preferably, a first of the two regions can comprise the first connecting structure and a second of the two regions can comprise the second connecting structure.

A "structural configuration that corresponds structurally" can, for example, be understood to mean that, when there are two structural elements, each one of the structural elements constitutes a counterpart to the respective other structural element in terms of providing a connection or coupling.

Consequently, at least two different structures can be provided on the end cap, which are configured in coordination with one another. Each of these structures can fulfill different functions and can influence the properties of the resulting connection in different ways. In this way, the properties that characterize assembly and disassembly, such as joining force and release force, for example, can be defined. Such a configuration furthermore makes it possible to achieve a defined alignment and positioning of the respective end caps in the connected state. Since the different connecting structures or regions correspond to one another, it is possible to at least ensure the provision of the actual connection.

The two regions can preferably be separated from one another by an imaginary line or straight line which separates and preferably bisects the main body, in particular the coupling side. The coupling structures of the two regions can be configured such that they are structurally correspondingly mirror-inverted with respect to the line or straight line.

Thus, for example, two identical and oppositely oriented end caps can be connected to one another via the coupling structures, because the respective coupling structures are disposed on the main body such that they can also be connected in a state in which they are rotated. It can further be achieved that the end cap has a symmetrical structure and/or symmetrical positioning at least with respect to the coupling structures. The precision of the positioning of two end caps relative to one another in the connected state can be improved as well, because the coupling structures are disposed at defined positions on the main body. It is also possible to simplify the production of the end cap.

According to a further development, the coupling structures can comprise projecting portions, recessed portions, and/or undercut portions. These projecting, recessed, and/or undercut portions can preferably be disposed at least in the direction which is orthogonal and/or parallel viewed in an extension plane of the flat main body. The coupling structures can preferably comprise corresponding latching projections and latching receptacles.

The coupling structures can thus be provided using simple structural design elements, by means of which in particular releasable connecting elements can be provided. It furthermore becomes possible to define characterizing properties of assembly and disassembly, such as joining force and release force, using structural design elements. Such a configuration also permits the connection of components to the end cap, provided they have corresponding coupling structures.

According to a further development, the coupling structures can comprise release structures, which enable a (preferably tool-free) release of the coupling structures of two end caps coupled via the coupling structures. The release structures can preferably enable a (tool-free) release of the coupling structures of two end caps coupled via the coupling structures in a defined direction, preferably in a direction orthogonal and/or parallel to an extension plane of the flat main body.

Two end caps coupled to one another can thus be released from one another by actuating a release structure provided specifically for this purpose. This can in particular counteract damage to the coupling structures during joining and/or also accidental release of the connection of two end caps.

According to another further development, the end cap, preferably the coupling side, can comprise receiving structures for receiving an end cap screen. The receiving structures can preferably comprise the coupling structures. Alternatively or additionally, the receiving structures can be configured to be mirror symmetrical with respect to an imaginary straight line which bisects the main body, in particular the coupling side. Further preferably, the receiving structures can comprise release means for releasing the end cap screen from the end cap (without the use of tools).

It thus becomes possible to fasten further components to the end cap in a simple manner, so that the functional scope of the end cap can additionally be expanded.

According to a further development, the cover side can comprise holding structures for releasably and/or non-releasably coupling to a light strip lamp. The holding structures can comprise coupling portions for mechanically coupling to corresponding structures of the light strip lamp bearing the end cap. The coupling portions can be latching or insertion structures, for example, and/or through-openings for receiving a fastening means, such as a screw or a latching pin.

Fastening of the end cap to a lamp can thus be achieved by simple means. This in particular makes it possible to provide a releasable and non-releasable connection of the end cap to the light strip lamp.

According to another further development, the end cap can be made of a light-impermeable or light-permeable material, in particular an opaque, translucent, transparent and/or crystal-clear material.

The end cap can thus be provided in keeping with the lighting situation, e.g. as inconspicuously as possible. Furthermore, when light-permeable materials are used, light striking the end cap can be transported through the end cap, so that the end cap can be used as a light guide, for example, or as a lamp housing.

According to a further development, the main body (preferably at least the cover side) can comprise a lamp receptacle for receiving an end cap lighting means, such as an LED, in order to make light emitted by the end cap lighting means available to the outside.

It is thus possible to provide a status LED or lighting means for LiFi applications on the end cap. The functional scope of the end cap can thus be expanded. It is also possible to pass information from the electronics accommodated in the lamp to the user in a simple manner. Among other things, this can also simplify the maintenance and installation of a component equipped with the end cap.

Alternatively or additionally, the end cap can preferably be made of a light-permeable and preferably crystal-clear material such that it serves as a light guide for an end cap lighting means which is disposed in the lamp receptacle and radiates into the main body, in order to preferably emit the light radiated in this manner to the outside via a preferably peripheral front face of the main body.

It thus becomes possible to use the end cap as a light guide for the light radiated by a status LED, for example, and to emit said light to the outside via its front face. The functional scope of the end cap can thus additionally be expanded.

A further aspect of the present invention relates to a light strip lamp comprising an elongated lamp support having two opposite end faces and the aforementioned end cap for covering one of the end faces by means of the flat cover side. The coupling side is provided on the outside. The light strip lamp can preferably comprise a lighting means accommodated in/on the lamp support and/or an end cap lighting means accommodated in the lamp receptacle for emitting light to the outside.

In other words: According to the invention, an elongated light strip lamp is provided, which comprises the aforementioned end cap on at least one of its end faces with an orientation in which the coupling structures are directed outward.

Such a light strip lamp can thus be shielded from environmental influences by the end cap. The light strip lamp also comprises the coupling structures of the end cap, so that individual light strip lamps can be connected together in a lamp grouping or a light strip system. In this respect, it is particularly advantageous that each of the light strip lamps represents a separate lighting unit that can be incorporated into such a grouping without additional structural adaptation.

A further aspect of the present invention relates to a light strip system comprising at least two of the aforementioned light strip lamps. The light strip lamps are connected to one another releasably and without the use of tools via the coupling sides provided on the outside of their respective end caps.

This makes it possible to achieve a flush arrangement (edge to edge) and precise alignment of the light strip lamps connected to the respective end caps in the light strip system, so that the occurrence of a gap during the assembly of the light strip system, for example, can be avoided. At the same time, it becomes possible to align and position the individual light strip lamps of the light strip system relative to one another by means of the respective coupling structures. It is furthermore possible to provide a grouping of light strip lamps that either shifts uniformly in the event of thermal expansion or mechanically counteracts the thermal expansions, i.e. offsets said thermal expansions by generating mechanical stress, for example. In both cases, the occurrence of gaps between the individual lighting means can be prevented, so that the overall appearance of the light strip system can be improved.

According to a further development, the front face of one of the light strip lamps forming a front face of the light strip system can comprise the aforementioned end cap as the end end cap for covering said front face by means of the flat cover side. The coupling side thereof can preferably be provided on the outside. Alternatively or additionally, the light strip system can comprise an end cap screen which is connected to the coupling side of the end end cap, preferably to the receiving structures thereof, for receiving the end cap screen.

This means that either the end cap already provided on the light strip lamp or an end cap screen (preferred by the customer) can be used as the terminating element of the light strip. The light strip system is thus provided in a cost-efficient and flexible manner.

BRIEF DESCRIPTION OF THE DRAWINGS

Further configurations and advantages of the present invention are discussed on the basis of the following design examples in conjunction with the figures of the accompanying drawings. The figures show.

DETAILED DESCRIPTION

Figure 1:
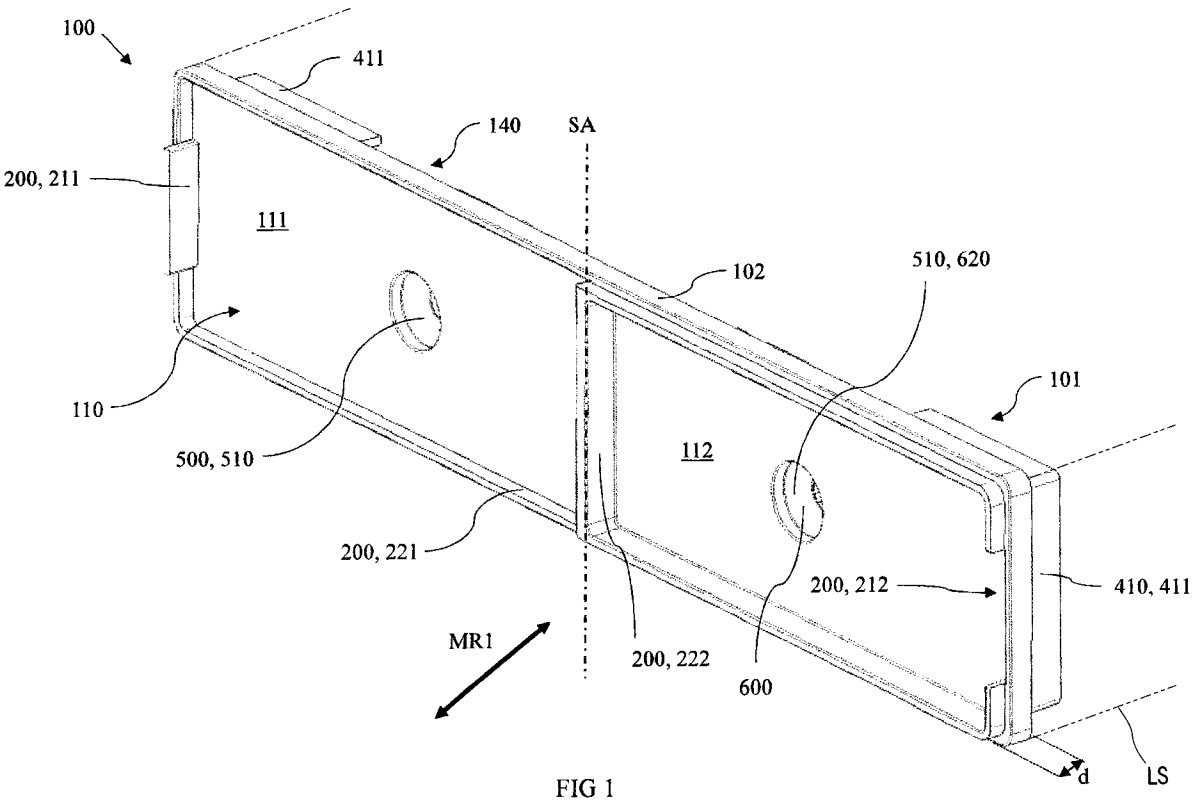
FIG. 1 a perspective illustration of a front view of an end cap according to a first embodiment of the invention.
Figure 2:
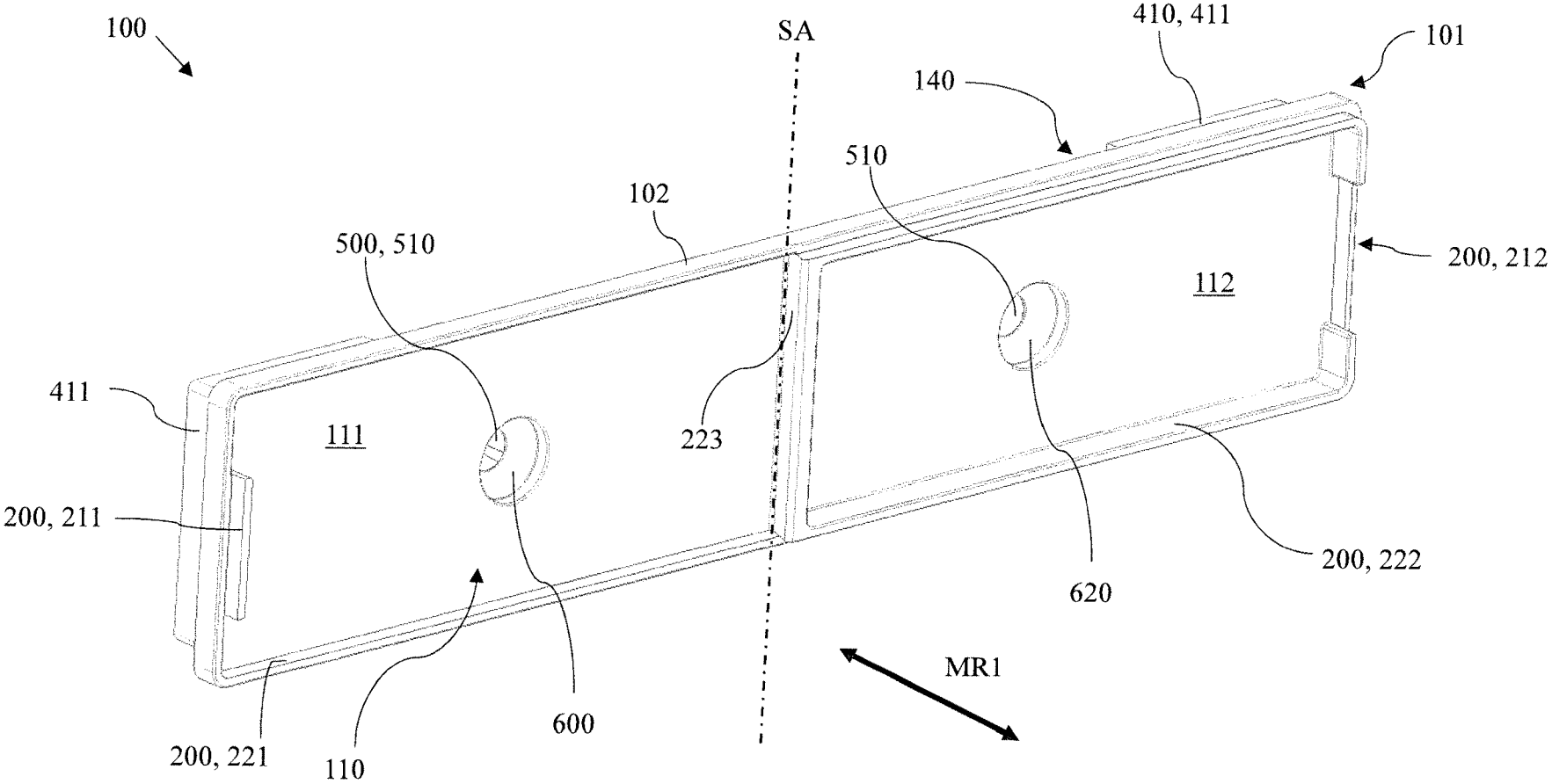
FIG. 2 a further perspective illustration of the end cap of FIG. 1.
Figure 3:
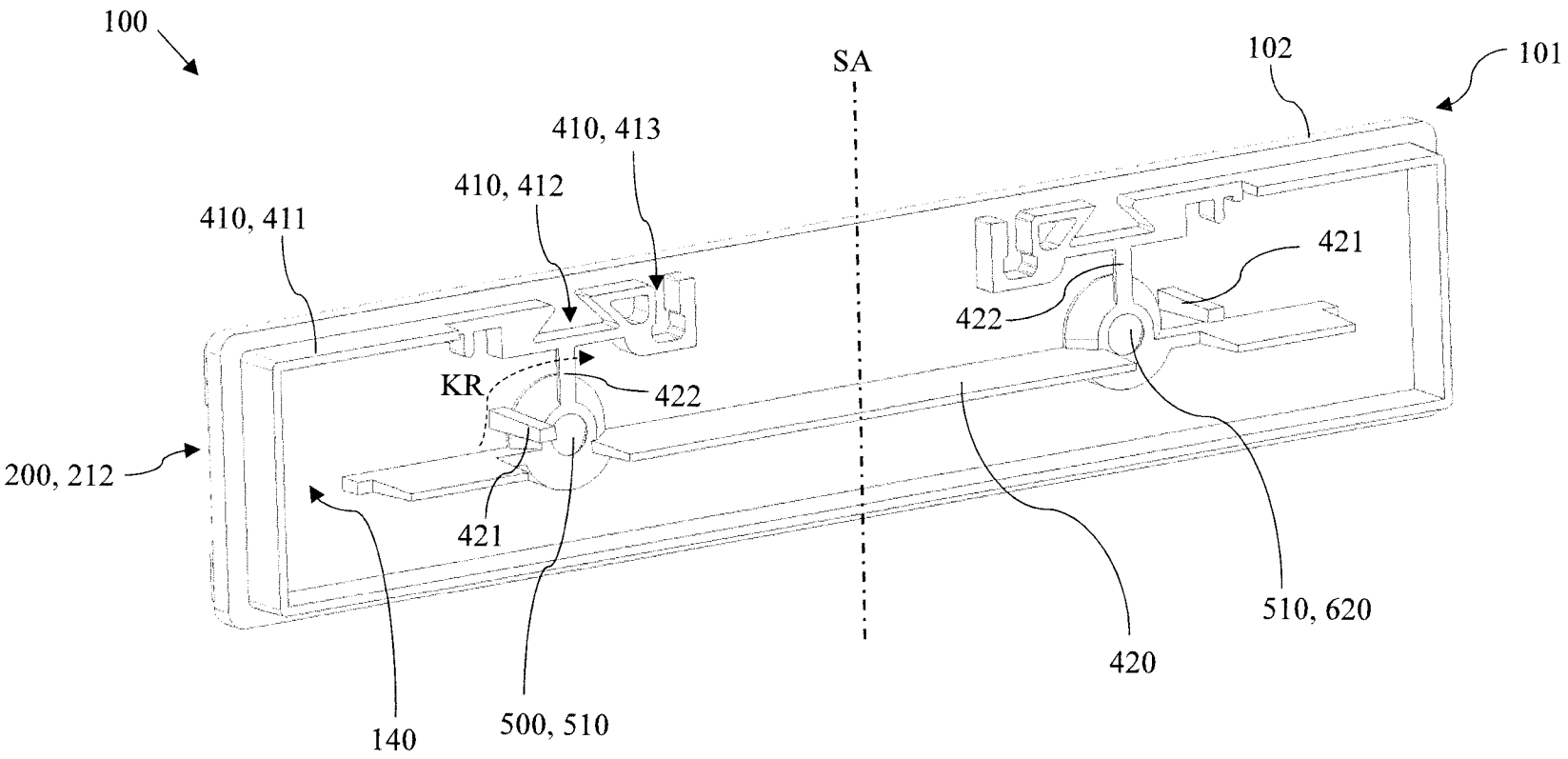
FIG. 3 a perspective rear view of the end cap of FIG. 1.

The figures show different views of different design examples of an end cap 100 according to the invention intended for a light strip lamp. FIGS. 1 to 3 show a first design example, FIGS. 4 to 11 show a further design example of the end cap 100 according to the invention.

The end cap 100 comprises a flat main body 101 having two opposite flat sides 110, 140. FIGS. 1 to 11 an example of the main body 101.

The end cap 100 or the main body 101 can be made of a light-impermeable or non-transparent (opaque) material.

Plastics or metals, such as aluminum or alloys, for example, can be used as materials for this purpose. Alternatively or additionally, the end cap 100 can be made of a light-permeable, in particular translucent, transparent or crystal-clear material. Plastics or glass, for example, can be used as materials for this purpose. However, it is also conceivable that a combination of light-impermeable and light-permeable materials is used for the end cap 100 or the main body 101, so that, for instance, the end cap 100 or the main body 101 partially or sectionally comprises light-permeable and light-impermeable regions. The main body 101 can be produced by injection molding or extrusion, for example. However, this list should not be considered to be exhaustive.

The main body 101 can have a cross-section of any shape. As an example, in FIGS. 1 to 11, the main body 101 has a rectangular cross-section. However, this should not be regarded as limiting for the invention. On the contrary, the main body can also have other cross-sectional shapes, for example a round, a circular or a cross-section consisting of a plurality of partial surfaces.

The main body 101 can be understood to be a flat body. The flat sides 110, 140 of the main body 101 can each extend substantially in one plane, whereby the respective planes can preferably be parallel to one another. A preferably completely peripheral front face 102 of the main body 101 can extend between the flat sides 110, 140. As a distance between the two flat sides 110, 140, the flat main body 101 can have a thickness d that is relatively small in comparison to the surface dimensions of the flat sides 110, 140. This is shown as an example in FIG. 1.

The flat sides 110, 140 comprise a flat cover side 140 for covering a front face of a light strip lamp. FIG. 3 shows an example of the cover side 140 according to the first design example of the end cap 100, and FIGS. 5, 6, 8, 10, 11 show an example according to the second design example.

The cover side 140 can comprise holding structures 410, 500 for releasably and/or non-releasably coupling the end cap 100 to a light strip lamp. This can preferably be seen in FIGS. 3 and 5, but can also be seen in the other figures. The holding structures 410, 500 can in particular comprise coupling portions.

The coupling portions can be configured as insertion structures 411, for example. For this purpose, the figures show an example of an at least partially peripheral rear wall 411 having the cross-section of the main body 101 (or having the circumference of the cover side 140). The rear wall 411 can be inserted into a corresponding groove or opening of a front face of a mounting rail, for example, and thus held there, for example by means of pressing or frictional forces. The rear wall 411 can also be configured to seal the mounting rail, for example as a sealing lip.

The holding structures 410, 500 can also be configured to correspond to structures of the lamp to be covered such that they can absorb expansions of the structures of the lamp. In this way, in particular thermal expansions of a lamp connected to the end cap 100 can be compensated or concealed.

Alternatively or additionally, the coupling portions can be configured as latching structures 412, 413, for example. For this purpose, appropriately correspondingly configured latching structures on the front face of the mounting rail, for example, can be brought into engagement with the latching structures 412, 413 disposed on the cover side 140.

Alternatively or additionally, the holding structures 410, 500 can be configured as through-openings 510, 520 for receiving a fastening means, such as a screw or a latching pin, for example, in order to enable mechanical coupling of the holding structures 410, 500 with corresponding structures of the light strip lamp bearing the end cap 100. Providing the holding structures 410, 500 on the cover side 140 can be advantageous in particular because the cover side 140 is preferably oriented toward the interior of the lamp during operation and is therefore not visible from the outside, so that the appearance of a corresponding lamp is not negatively affected by the holding structures 410, 500.

The end cap 100 can also comprise guide structures 421, 422 on the cover side 140 for cable routing. Examples of these are shown in FIGS. 3, 5, 8 and 10. The figures further illustrate how a cable can be guided along the clamping direction KR and clamped to the cover side 140 via the through-passage 422. The cabling can thus correspondingly be routed through the end cap 100 prior to installation of the end cap 100 or other components into the lamp. Thus, when the end cap 100 is put on, cables cannot be jammed between the end cap 100 and the lamp to be covered by said end cap, because the cable is already secured in the end cap 100. To reduce the risk of cable breakage due to excessively tight bending radii and/or to keep the cable in place during an assembly procedure, bending columns 421 can further be provided on the cover side 140. For this purpose, a separating web 420 can also be provided on the cover side 140, which preferably extends at least partially between the peripheral rear wall 411. The separating web 420 and the rear wall 411 can be configured to correspond with one another such that a labyrinth seal, for example, can be implemented on the cover side 410. This is illustrated in particular in FIG. 3.

Figure 4:
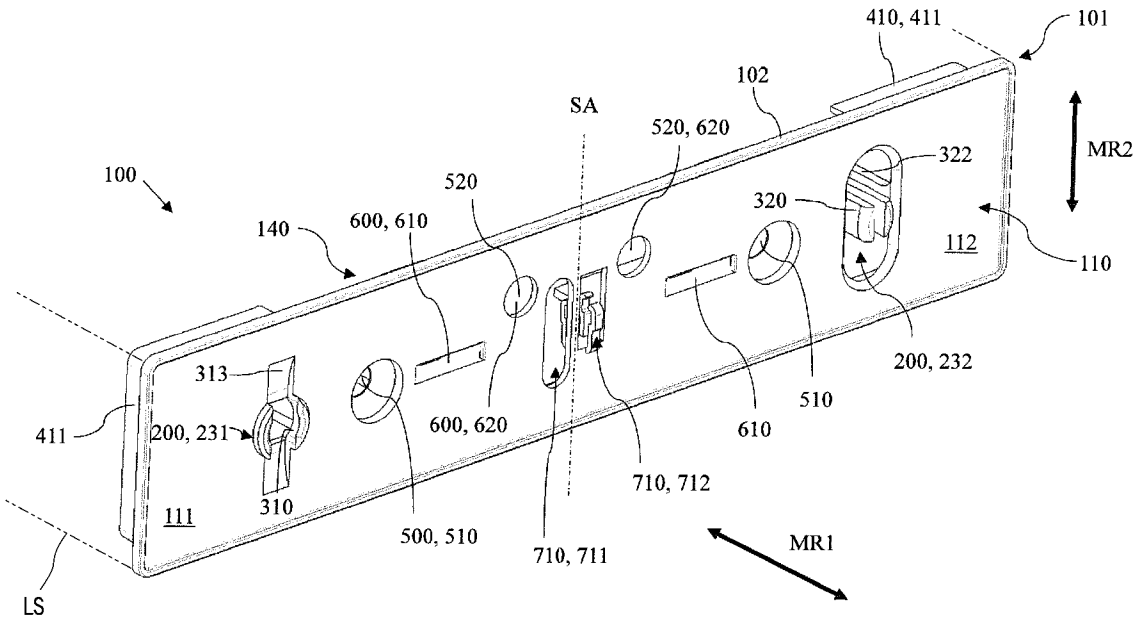
FIG. 4 a perspective illustration of a front view of an end cap according to a second embodiment of the invention.
Figure 5:
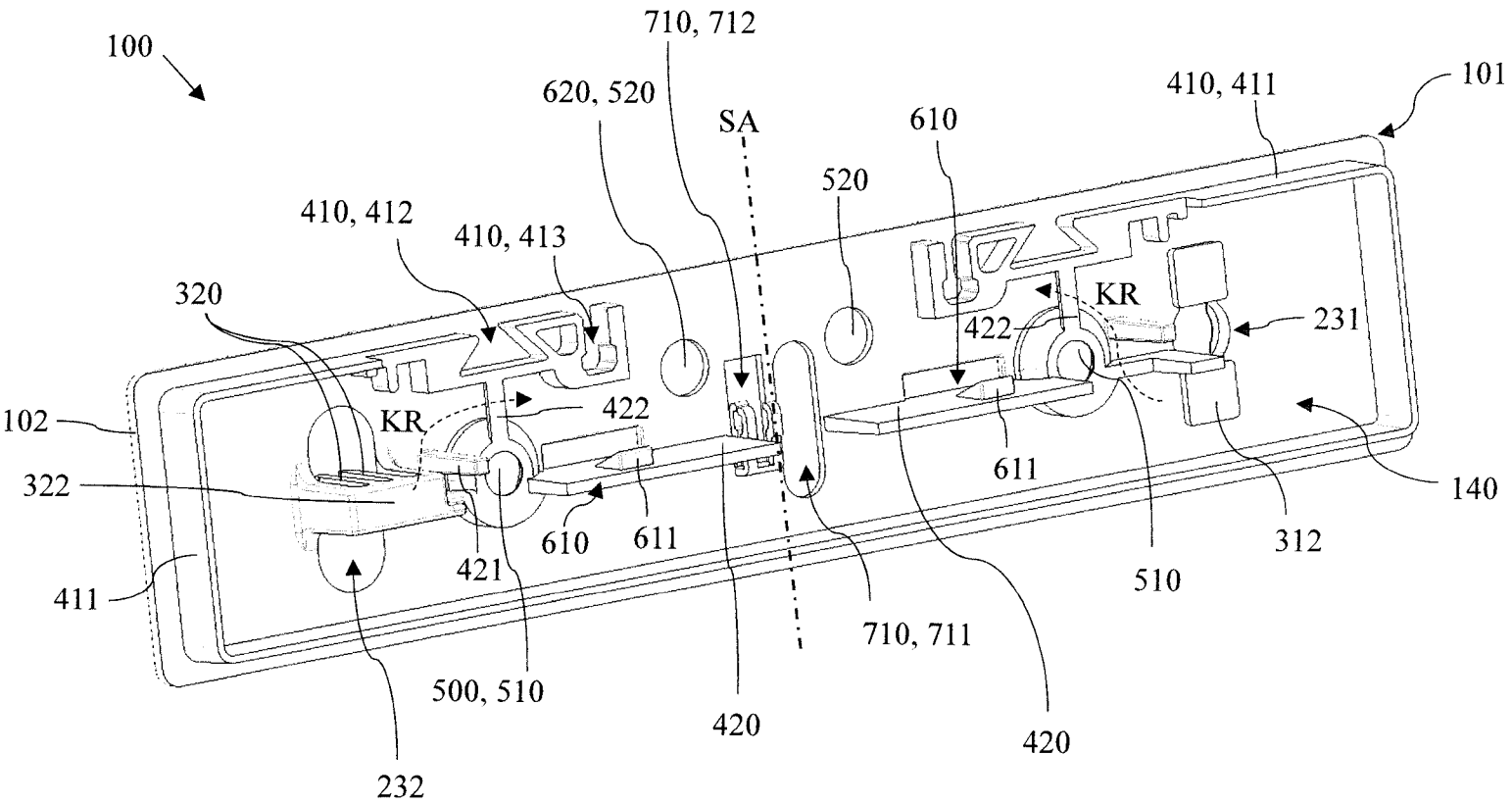
FIG. 5 a perspective rear view of the end cap of FIG. 4.
Figure 11:
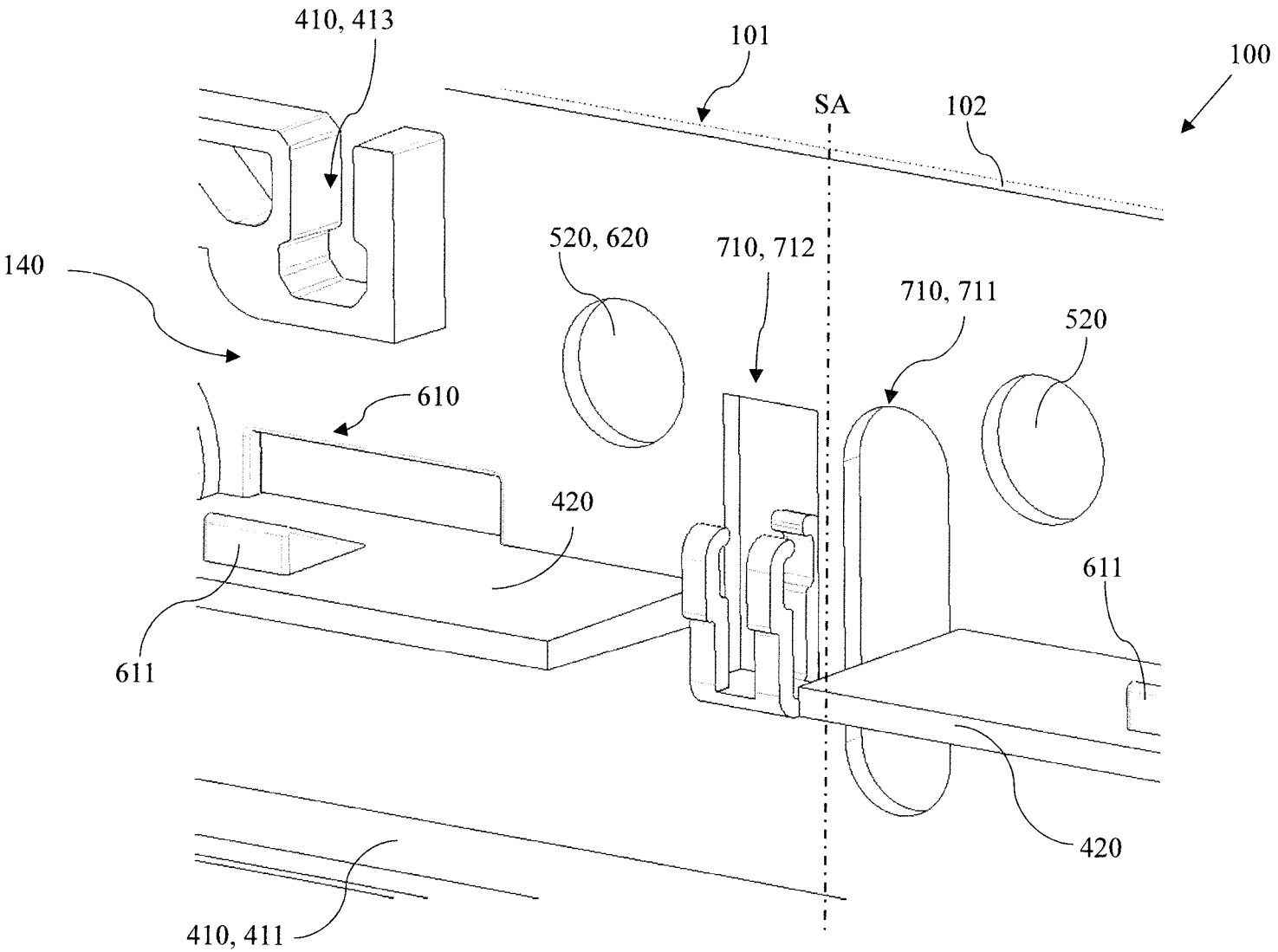
FIG. 11 an enlarged third partial illustration of the rear view of FIG. 5.

The main body 101 or preferably at least the cover side 140 can further comprise a lamp receptacle 710 for receiving an end cap lighting means, such as an LED. Examples of this are shown in FIGS. 4 bis 6, 8, 10 and 11. FIG. 11 in particular shows an enlarged example illustration of the lamp receptacle 710. The lamp receptacle 710 can optionally be formed by a latching structure 712 or an opening 711 in the cover side 140. It is also conceivable, however, that the lamp receptacle 710 is implemented via the through-openings 520, for example.

The end cap lighting means can preferably be disposed in the lamp receptacle 710 such that its emitted light is emitted to the outside from the end cap 100, i.e. preferably in at least one direction oriented away from the cover side 140. For instance, the end cap 100 can thus be made of a light-permeable and preferably crystal-clear material such that it serves as a light guide for an end cap lighting means which is disposed in the lamp receptacle 710 and radiates into the main body 101. The light radiated in this way can thus be emitted to the outside via the (peripheral) front face 102 of the main body 101.

The flat sides 110, 140 also comprise a coupling side 110 for coupling to an identical end cap 100 of a laterally adjacent light strip lamp. This is shown particularly advantageously in FIGS. 1, 2 and 4.

The end cap 100, or in particular the coupling side 110, can comprise receiving structures 600 for receiving an end cap screen. Examples of these are shown in all of the figures. The receiving structures 600 can be formed by through-openings 620, for example, or by latching structures 610. The separating web 420 can comprise a wedge-shaped latching projection 611, for example, which can preferably be connected to a corresponding latching structure of the end cap screen via the coupling side 110. This is shown in FIGS. 5 to 11, for example. It is in particular also conceivable that the holding structures 500 are used as receiving structures 600 too.

Figure 6:
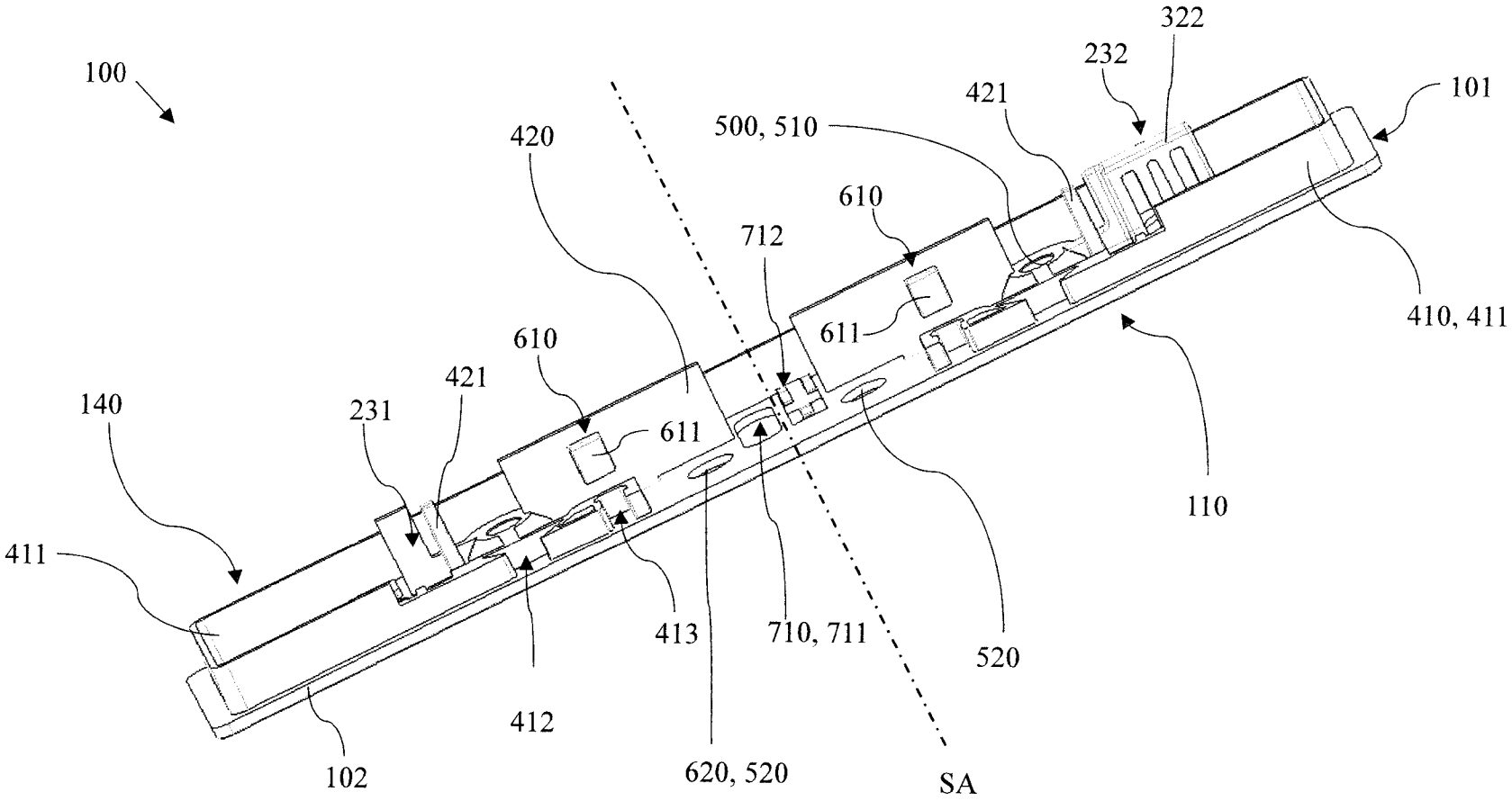
FIG. 6 a perspective plan view onto the end cap of FIG. 4.
Figure 7:
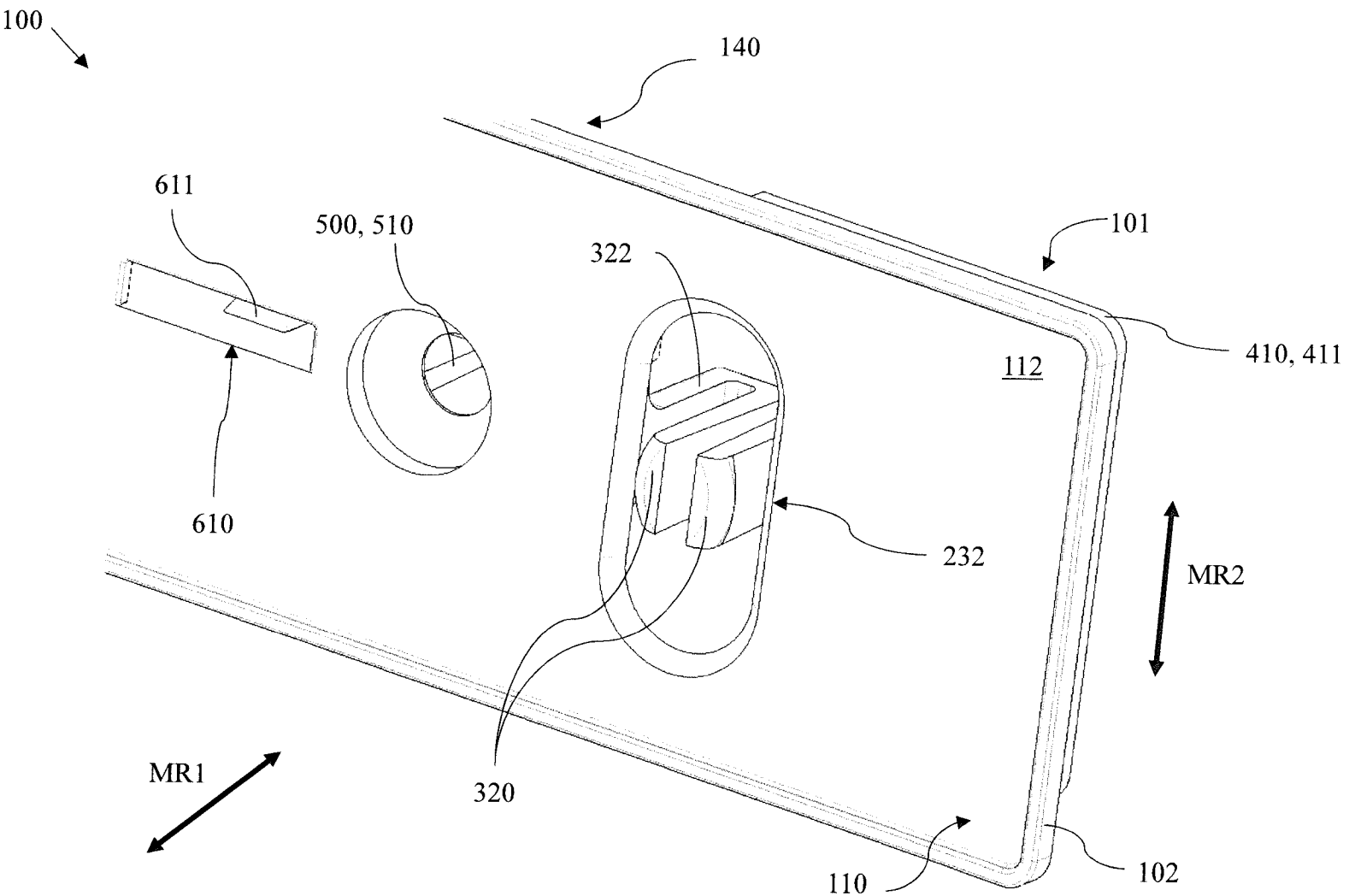
FIG. 7 an enlarged first partial illustration of the front view of FIG. 4.
Figure 8:
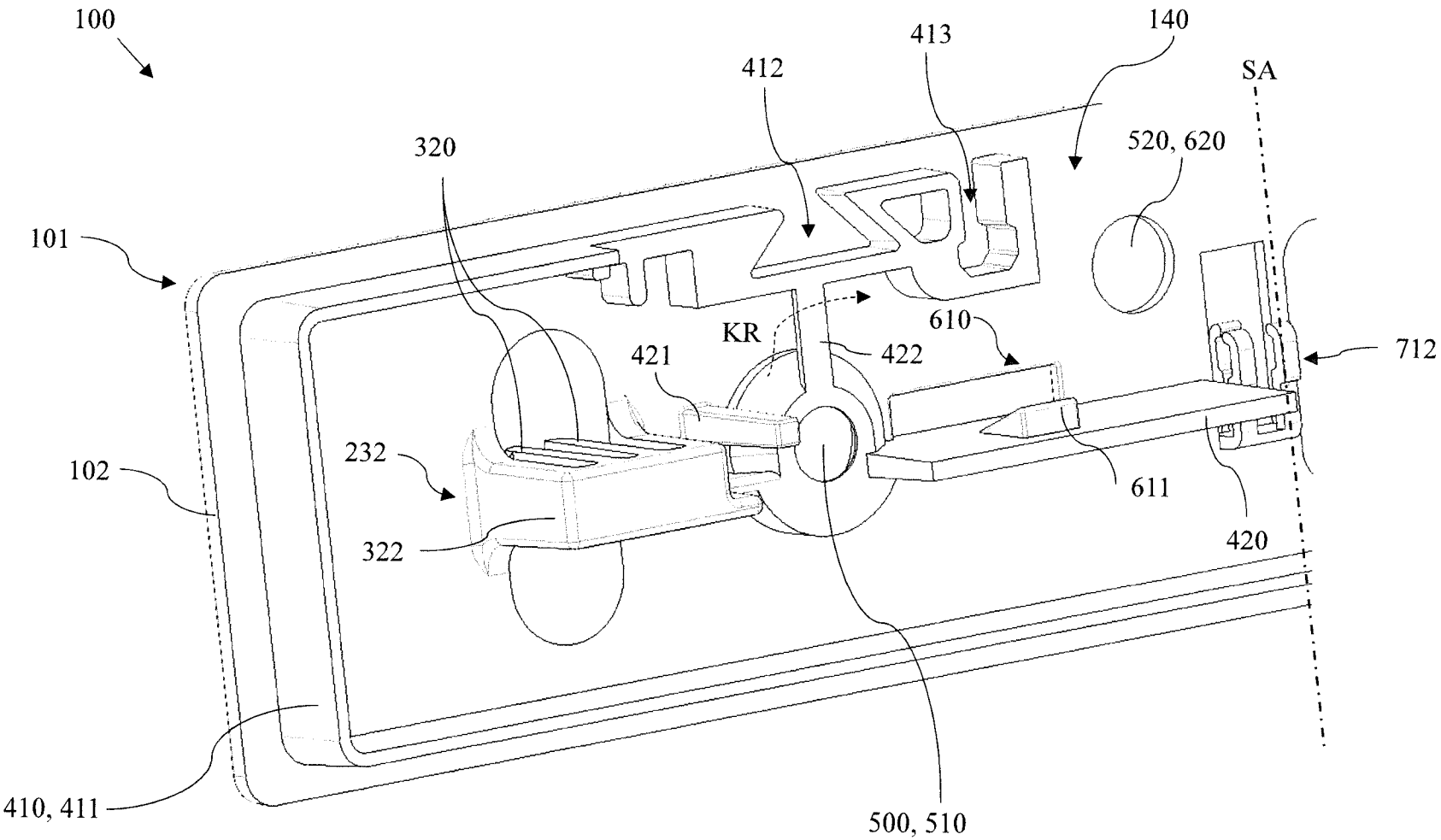
FIG. 8 an enlarged first partial illustration of the rear view of FIG. 5, which corresponds to the illustration of FIG. 7.

The receiving structures 600 can preferably be configured to be mirror symmetrical with respect to an imaginary straight line SA which bisects the main body 101, in particular the coupling side 110. The receiving structures 600 can thus be equally spaced with respect to the imaginary straight line SA. FIGS. 1 to 6 show examples of this. The straight line SA can be an axis of symmetry of the (cross-section of the) main body 101 or a plane of symmetry of the main body 101, as shown in FIG. 6.

The coupling side 110 comprises coupling structures 200. The figures show examples of different design examples of the coupling structures 200. The coupling structures 200 are configured such that they can be releasably connected to the coupling structures 200 of a coupling side 110 of an identical end cap 100 without the use of tools.

The coupling structures 200 can each comprise a first connecting structure 211, 221, 231 and a second connecting structure 212, 222, 232, which are configured to correspond structurally to the tool-free and releasable connection to the respective other connecting structure of an identical end cap 100. This is in particular evident from the figures.

For instance, FIGS. 1 and 2 show two possible configurations of the coupling structures 200. The second connecting structure 222 of the coupling structure 200 in FIGS. 1 and 2, for example, is configured as a projection which extends away from the coupling side 110 and encloses a section of the coupling side 110. The first connecting structure 221 of the coupling structure 200 of FIG. 1 is configured as a recess in/from the coupling side 110, which is preferably enclosed by the front face 102 of the main body 101. Thus it becomes clear that the connecting structures 221, 222 of the coupling structures 200 can be configured as two corresponding counterparts.

Precise positioning and stronger connection between two end caps 100 connected via the coupling structures 200 can preferably be achieved by the respective counterparts having a common joining section 223. An example of this is shown in FIG. 2. The joining section 223 can be configured as a common wall section separating the respective coupling structures 200. The joining section 223 can preferably be configured as a stepped back section. The joining section 223 can be configured as a stepped back section which extends obliquely outward away from the coupling side 110 and can preferably be disposed (ec)centrically of the coupling side 110. The joining section 223 can have a substantially wedge-shaped cross-section in the joining direction of two identical end caps 100. This makes it possible, for example, to achieve a visual merging of two identical end caps 100. The wedge shape of the joining section 223 also produces larger holding forces between the connected components. This effect is further intensified by thermal expansion.

The coupling structures 200 can also be configured as corresponding latching structures. As an example, FIGS. 1 and 2 show the second connecting structure 212 of the coupling structure 200 as a frontally positioned locking spring receptacle, which corresponds to a first connecting structure 211 of the coupling structure 200 configured as a locking spring.

FIGS. 4 to 11 show a further example, in which the coupling structures 200 comprise latching projections and latching receptacles that are configured to corresponding with one another.

Figure 9:
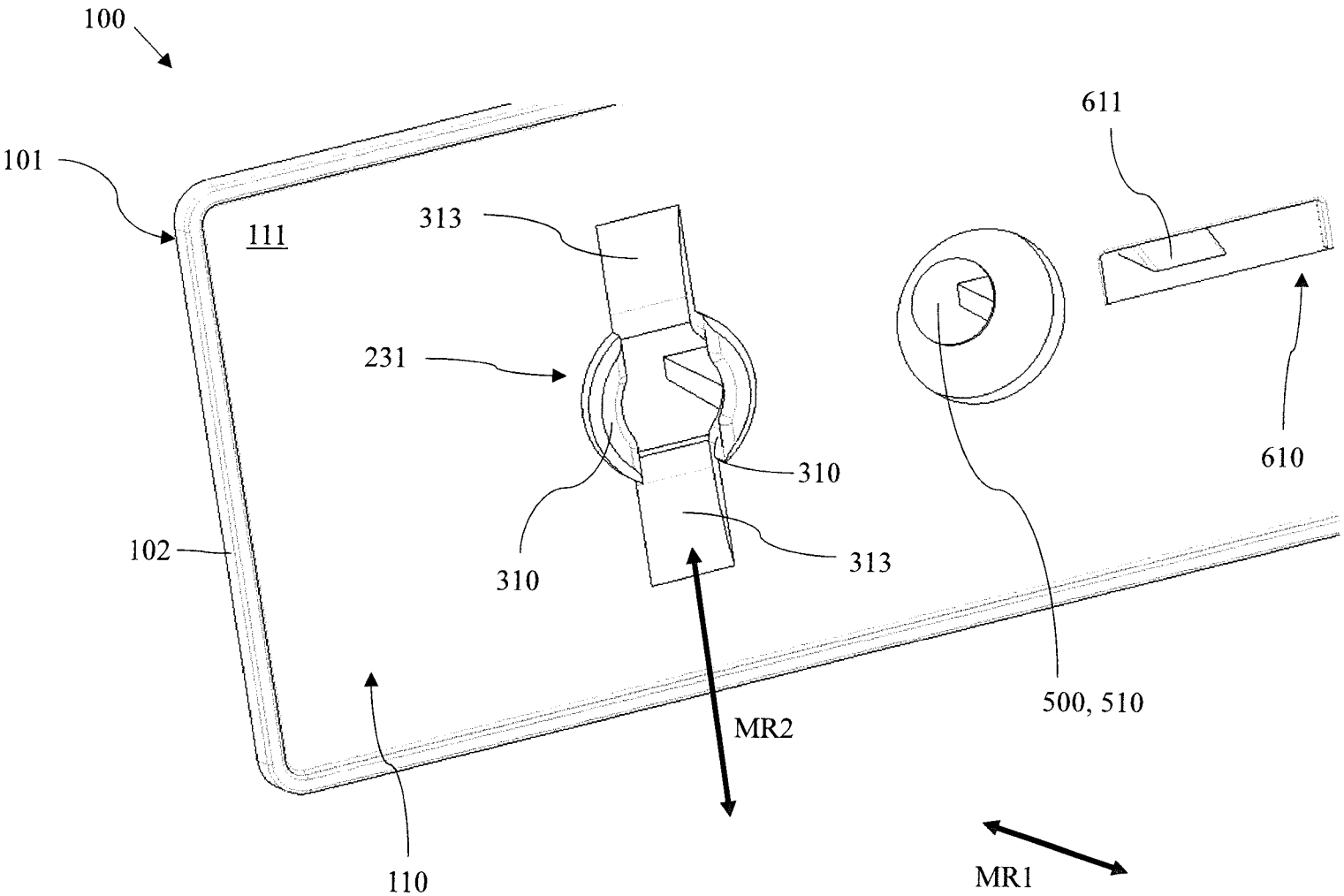
FIG. 9 an enlarged second partial illustration of the front view of FIG. 4.
Figure 10:
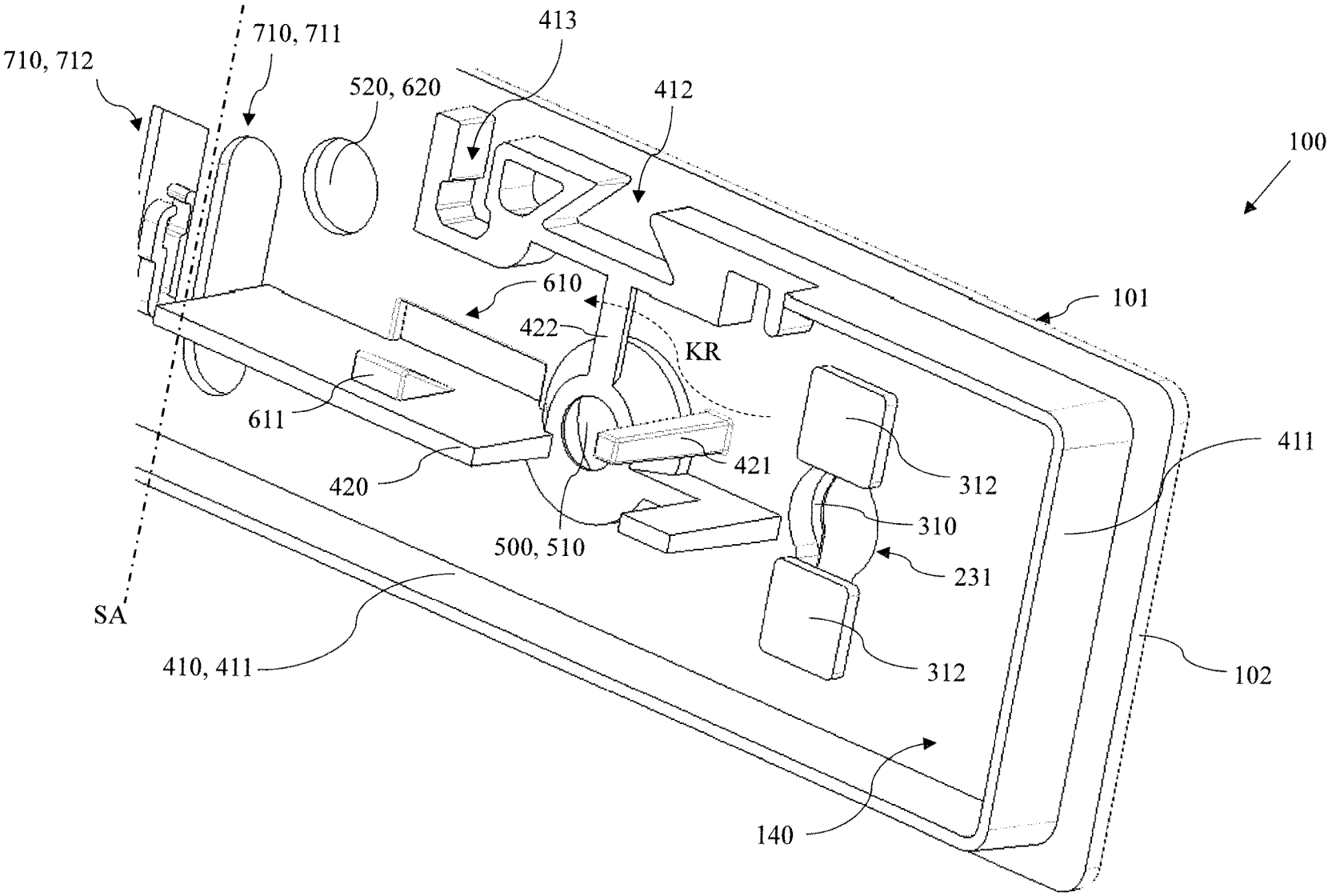
FIG. 10 an enlarged second partial illustration of the rear view of FIG. 5, which corresponds to the illustration of FIG. 9.

The first connecting structure 231 of the coupling structure 200 can comprise recessed portions 310 and undercut portions. FIGS. 9 and 10 respectively show enlarged front and rear views of the first connecting structure 231. In the figures, the first connecting structure 231 is shown as a component, for instance, and can be configured as a (partially) circular receptacle. The first connecting structure 231 can comprise fastening sections 312 for fastening to the cover side 140. The fastening sections 312 can preferably be configured to correspond to the recessed portions 310 such that the first connecting structure 231 is held in a through-opening of the main body 101. As preferably shown in FIGS. 9 and 10, the recessed portions 310 can extend at least in a direction MR1 orthogonal to an extension plane of the flat main body 101 and/or at least in a direction MR2 which is parallel viewed in an extension plane of the flat main body 101. The orthogonal direction MR1 and the parallel direction MR2 can preferably be assembly directions for joining or separating identical end caps 100.

The second connecting structure 232 can comprise projecting portions 320, which are preferably configured to correspond to the first connecting structure 231 and further preferably extend at least along the orthogonal direction MR1 or the parallel direction MR2. The second connecting structure 232 is shown enlarged in a front and rear view in FIGS. 7 and 8. For example, the second connecting structure 232 can comprise two partial circular segment-like, preferably resilient arms or can be configured as a slotted cylindrical pin. The second connecting structure 232 can be provided integrally with the main body 101. The projecting portions 320 can preferably be connected to the cover side 140 via a common bracket portion 322. The coupling structures 200 can form the receiving structures 600.

Each aforementioned example illustrates how the coupling structures 200 can be configured to correspond structurally such that a tool-free and releasable connection can be provided. It will furthermore be clear from the aforementioned design examples that the coupling structures 200 can also be provided in such a way that two end caps 100 coupled via the coupling structures 200 are aligned with one another.

The coupling structures 200 can be configured such that two end caps 100 coupled via the coupling structures 200 can be released via a relative movement of the end caps 100 to one another. For this purpose, the relative movement can take place at least in the orthogonal direction MR1 and/or in the parallel direction MR2. However, it is also conceivable that the relative movement is a rotation or a tilting.

The coupling structures 200 can also comprise release structures 313, which enable a tool-free release of the coupling structures 200 of two end caps 100 coupled via the coupling structures 200 in a defined direction, preferably in the orthogonal direction MR1 and/or in the parallel direction MR2. Examples of this are shown in the figures. The release structures 313 can be provided integrally with the coupling structure 200. Alternatively or additionally, the release structures 313 can also be provided in the main body 101, in particular the coupling side 110. For instance, the first connecting structure 231 configured as a slotted receptacle can comprise a circular release structure 313 that is slotted longitudinally, whereby the slot preferably transitions on both sides into an ejection slope. FIGS. 4 and 9, for example, show this in a particularly suitable manner.

The main body 101, in particular the coupling side 110, can also comprise two regions 111, 112 which are configured to correspond structurally to one another. A first region 111 of the two regions 111, 112 can comprise the first connecting structure 211, 221, 231 and a second region 112 of the two regions 111, 112 can comprise the second connecting structure 212, 222, 232. This can be seen particularly well in FIGS. 1, 2 and 4.

The two regions 111, 112 can preferably be separated from one another by a straight line SA which separates and preferably bisects the main body 101, in particular the coupling side 110. The coupling structures 200 of the two regions 111, 112 can preferably be configured such that they are structurally correspondingly mirror-inverted with respect to the straight line SA.

The end cap 100, but in particular the coupling side 110 and/or the cover side 140, can preferably have an asymmetrical structure, for example due to the structurally corresponding (opposite) configuration of the coupling structures 200 or lamp receptacle 710, and at the same time have a preferably symmetrical structure with respect to the positioning of the individual elements. In this case, the connection between two identical end caps 100 can be achieved by the presence of symmetry components in the end cap design, for example, and a precise positioning and attachment of the two end caps 100 can be achieved by the presence of asymmetry components in the end cap design. The end cap 100 can thus be configured as an asymmetrical identical part.

It is also possible to provide a plurality of differently configured coupling structures 200 on the coupling side 110. The respective corresponding connecting structures can be disposed in almost any way on the coupling side 110, depending on the cross-sectional shape of the main body 101 and the structural configuration of the coupling structures 200. The coupling structures 200 can preferably be positioned on/at/in the coupling side 100 such that respective corresponding connecting structures are disposed evenly spaced at least with respect to two opposite edges of the coupling side 110. This is merely an example configuration option of the end cap 100.

The invention further relates to a light strip lamp and a light strip system. The light strip lamp according to the invention and the light strip system according to the invention are not shown in any of the illustrations, but are clarified among other things based on the following description.

The light strip lamp comprises an elongated lamp support having two opposite end faces. The interior of the lamp can preferably be formed by the lamp support. The light strip lamp also comprises the aforementioned end cap 100 for covering one of the end faces of the lamp support by means of the flat cover side 140. The coupling side 110 is provided on the outside (i.e. not toward the interior of the lamp). The light strip lamp can comprise a lighting means accommodated in or on the lamp support. Alternatively, or additionally, the light strip lamp can comprise an end cap lighting means accommodated in the lamp receptacle 710 for emitting light to the outside.

The light strip system according to the invention comprises at least two of the aforementioned light strip lamps. The two light strip lamps are connected to one another releasably and without the use of tools via the coupling sides 110 provided on the outside by their end caps 100.

For this purpose, the end caps 100 of two adjacent light strip lamps can be brought into an arrangement in which they are rotated relative to one another. For this purpose, the end caps 100 are preferably respectively connected to the respective light strip lamp. This makes it possible to achieve that corresponding regions of the coupling structures 200 of both end caps 100, in particular of the first and second connecting structures, can engage in one another. A form-locking connection in at least the longitudinal direction of the light strip lamps, a restriction of at least one of their degrees of freedom and/or also a positioning of the light strip lamps relative to one another can thus be ensured.

The front face of one of the light strip lamps forming a front face of the light strip system can comprise an end cap 100 as the end end cap for covering said front face by means of the flat cover side 140. The coupling side 110 thereof can preferably be provided on the outside. The light strip system can furthermore also comprise an end cap screen which can be connected to the coupling side 110 of the end end cap, preferably to the receiving structures 600 thereof, for receiving the end cap screen.

The present invention is not limited by the aforementioned design examples, provided it is covered by the subject matter of the following claims. It is in particular possible to combine and interchange all features of the design example with and among one another in any manner.

What is claimed is:

1. An end cap (100) for a light strip lamp, comprising:

a flat main body (101) having two opposite flat sides (110, 140), wherein the flat sides (110, 140) comprise a flat cover side (140) for covering an end face of a light strip lamp and a coupling side (110) for coupling to an identical end cap (100) of a laterally adjacent light strip lamp, wherein the coupling side (110) comprises coupling structures (200) which are configured such that they can be releasably connected to the coupling structures (200) of a coupling side (110) of an identical end cap (100) without the use of tools.

2. The end cap (100) according to claim 1, wherein the coupling structures (200) are configured to align two end caps (100) coupled via the coupling structures (200) with one another.

3. The end cap (100) according to claim 1, wherein the coupling structures (200) are configured to release two end caps (100) coupled via the coupling structures (200) via a relative movement of the end caps (100) to one another at least in a direction orthogonal (MR1) and/or parallel (MR2) to an extension plane of the flat main body (101).

4. The end cap (100) according to claim 1, wherein the coupling structures (200) each comprise a first connecting structure (211, 221, 231) and a second connecting structure (212, 222, 232), which are configured to correspond structurally to the tool-free and releasable connection to the respective other connecting structure of an identical end cap (100).

5. The end cap (100) according to claim 1, wherein the main body (101), in particular the coupling side (110), comprises two regions (111, 112) which are configured to correspond structurally to one another, wherein a first of the two regions (111) comprises the first connecting structure (211, 221, 231) and a second (112) of the two regions (111, 112) comprises the second connecting structure (212, 222, 232).

6. The end cap (100) according to claim 5, wherein the two regions (111, 112) are separated from one another by an imaginary line or straight line (SA) which separates and bisects the main body (101), in particular the coupling side (110), wherein the coupling structures (200) of the two regions (111, 112) are configured such that they are structurally correspondingly mirror-inverted with respect to the imaginary line or straight line (SA).

7. The end cap (100) according to claim 1, wherein, at least when viewed in the direction orthogonal (MR1) and/or parallel (MR2) to an extension plane of the flat main body (101), the coupling structures (200) comprise projecting portions (320) and/or recessed portions (310) and/or undercut portions.

8. The end cap (100) according to claim 1, wherein the coupling structures (200) comprise corresponding latching projections and latching receptacles.

9. The end cap (100) according to claim 1, wherein the coupling structures (200) comprise release structures (313) which enable a tool-free release of the coupling structures (200) of two end caps (100) coupled via the coupling structures (200) in a defined direction, in a direction orthogonal (MR1) and/or parallel (MR2) to an extension plane of the flat main body (101).

10. The end cap (100) according to claim 1, wherein the end cap (100) comprises receiving structures (600) for receiving an end cap screen, wherein the receiving structures (600) comprise the coupling structures (200) or wherein the receiving structures (600) are mirror symmetrical with respect to an imaginary straight line (SA) which bisects the main body (101), in particular the coupling side (110).

11. The end cap (100) according to claim 1, wherein the cover side (140) comprises holding structures (410, 500) for releasable and/or non-releasable coupling to a light strip lamp, wherein the holding structures (410, 500) comprise coupling portions, such as latching or insertion structures (411-413), and/or through-openings (510, 520) for receiving a fastening means for mechanically coupling to corresponding structures of the light strip lamp bearing the end cap (100).

12. The end cap (100) according to claim 1, wherein the main body (101) further comprises a lamp receptacle (710) for receiving an end cap lighting means in order to make light emitted by the end cap lighting means available to the outside.

13. The end cap (100) according to claim 12, wherein the end cap (100) is made of a light-permeable and crystal-clear material such that it serves as a light guide for an end cap lighting means which is disposed in the lamp receptacle (710) and radiates into the main body (101), in order to emit the light radiated in this manner to the outside via a peripheral end face of the main body (101).

14. The end cap (100) according to claim 1, wherein the end cap (100) is made of a light-impermeable or light-permeable material, in particular an opaque or translucent or transparent or crystal-clear material.

15. A light strip lamp comprising an elongated lamp support with two opposite end faces and the end cap (100) according to claim 1 for covering one of the end faces by means of the flat cover side (140), wherein the coupling side (110) is provided on the outside.

16. The light strip lamp according to claim 15, further comprising lighting means accommodated in or on the lamp support and/or end cap lighting means accommodated in the lamp receptacle (710) for emitting light to the outside.

17. The light strip system comprising at least two light strip lamps according to claim 15, wherein the light strip lamps are connected to one another releasably and without the use of tools via the coupling sides (110) of their end caps (100) provided on the outside.

18. The light strip system according to claim 17, wherein the coupling side (110) is provided on the outside, and further comprises an end cap screen which is connected to the coupling side (110) of the end cap for receiving the end cap screen.

* * * * *